US011844978B2

(12) United States Patent
Hansen

(10) Patent No.: US 11,844,978 B2
(45) Date of Patent: Dec. 19, 2023

(54) TOTAL BODY EXERCISE MACHINE

(71) Applicant: Mark D. Hansen, Cayuta, NY (US)

(72) Inventor: Mark D. Hansen, Cayuta, NY (US)

( * ) Notice: Subject to any disclaimer, the term of this patent is extended or adjusted under 35 U.S.C. 154(b) by 101 days.

(21) Appl. No.: 17/668,349

(22) Filed: Feb. 9, 2022

(65) Prior Publication Data

US 2022/0266088 A1 Aug. 25, 2022

Related U.S. Application Data

(60) Provisional application No. 63/147,654, filed on Feb. 9, 2021.

(51) Int. Cl.
*A63B 22/06* (2006.01)
*A63B 21/22* (2006.01)
*A63B 23/035* (2006.01)

(52) U.S. Cl.
CPC ..... *A63B 22/0605* (2013.01); *A63B 21/225* (2013.01); *A63B 23/03525* (2013.01); *A63B 2022/0647* (2013.01); *A63B 2225/09* (2013.01)

(58) Field of Classification Search
CPC ..... A63B 22/0605; A63B 21/225; A63B 23/03525; A63B 2022/0647; A63B 2225/09; A63B 2220/51; A63B 2225/093; A63B 22/0012
See application file for complete search history.

(56) References Cited

U.S. PATENT DOCUMENTS 1,820,372 A * 8/1931 Blomquist ..... A63B 22/001 482/62
4,693,468 A * 9/1987 Kurlytis ..... A63B 22/0605 482/130
5,342,262 A * 8/1994 Hansen ..... A63B 22/0605 482/62
5,928,115 A * 7/1999 Arroyo, Jr. ..... A63B 22/0605 482/62
5,947,874 A * 9/1999 Dougherty ..... A63B 22/0012 482/52
6,500,100 B1 * 12/2002 Harrell ..... A63B 21/157 482/57
8,647,240 B2 * 2/2014 Heidecke ..... A63B 22/0005 482/4
10,507,354 B2 * 12/2019 Kiani ..... A63B 21/00192
11,033,767 B2 * 6/2021 Phillips ..... A63B 21/0083
2012/0238411 A1 * 9/2012 McBride ..... A63B 22/0005 482/57
2017/0056717 A1 * 3/2017 Ercanbrack ..... A63B 21/4034
2018/0111019 A1 * 4/2018 Ellis ..... A63B 22/0023
2019/0344112 A1 * 11/2019 Phillips ..... A63B 22/04
2020/0061409 A1 * 2/2020 Lin ..... A63B 21/225

* cited by examiner

*Primary Examiner* — Andrew S Lo
*Assistant Examiner* — Andrew M Kobylarz
(74) *Attorney, Agent, or Firm* — Barry Choobin; Patent 360

(57) ABSTRACT

An exercise machine for a total body workout includes a platform, a lower frame mounted over the platform, and an upper frame mounted to the lower frame. The platform includes recoiling shock absorbers such as springs. A lower drive assembly includes a pair of pedals mounted to the lower frame. An upper drive assembly includes a pair of handles mounted to the upper frame. A person for exercise can stand on the pair of peddles while grabbing the pair of handles. Thereafter, the person can rotate the pair of the peddles by legs and the pair handles by hands in the cycling motion.

12 Claims, 2 Drawing Sheets

TOTAL BODY EXERCISE MACHINE

CROSS-REFERENCE TO RELATED APPLICATIONS

This application claims priority from the U.S. provisional patent application Ser. No. 63/147,654, filed on Feb. 9, 2021, which is incorporated herein by reference in its entirety.

FIELD OF INVENTION

The present invention relates to an exercise machine for a total body workout, and more particularly, the present invention relates to a resistance-based total body exercise machine for building strength and coordination.

BACKGROUND

A variety of exercise machines are available for exercise various parts of the body. People use exercise machines for a variety of purposes, such as to burn calories, for general wellbeing, to build muscle strength, to build endurance, and sharpen the skills and coordination in movements. Athletes use a range of different types of exercise machines for building an overall strength of the body and to improve coordination between different body movements. For legs workout, exercise machines such as treadmills, cycles, leg press, leg extension machines, and the like are available. Similarly, different exercise machines are available to exercise the arms, shoulders, chest, and waist.

Different exercise machines for a full-body workout are generally available in public/shared facilities, such as gyms. Moreover, using the different machines for an overall body workout can become tedious and time-consuming. Another major drawback of the existing exercise machines is the lack of coordination between different body movements. Therefore, a long felt and unsolved need is there for a total body exercise machine for a total body workout and building coordination skills between different body movements.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a total body exercise machine for an overall body workout.

It is another object of the present invention that the exercise machine is compact in design.

It is still another object of the present invention that the exercise machine aid in building coordination between body movements.

It is yet another object of the present invention that the exercise machine can be adapted to the weight and height of the user.

In aspect, disclosed is an exercise machine comprising a platform having a proximal end and a distal end, the proximal end comprises a front bar mounted over a front base and one or more recoiling shock absorbers sandwiched between the front bar and the front base, the distal end of the platform comprises a rear bar pivotally coupled to a rear base; a lower frame mounted over the platform; a lower drive assembly mounted to the lower frame, the lower drive assembly comprises a pair of pedals; an upper frame mounted to the lower frame; and an upper drive assembly mounted to the upper frame, the upper drive assembly comprises a pair of handles, wherein the exercise machine is configured such that a person can stand on the pair of pedals while grabbing the pair of handles and rotate the pair of pedals by legs and the pair of handles by hands in a cycling motion.

In one implementation of the exercise machine, the front bar is parallel to the rear bar, wherein the platform further comprises one or more support bars that extend between the front bar and the rear bar. The front base and the rear base are integral. The upper frame is telescopically coupled to the lower frame such that to increase or decrease a distance between the upper drive assembly and the lower drive assembly. The lower drive assembly comprises a first flywheel operably coupled to the pair of pedals, and a first variable resistance member configured to resist a rotation of the first flywheel. The upper drive assembly comprises a second flywheel operably coupled to the pair of handles, and a second variable resistance member configured to resist a rotation of the second flywheel.

In one aspect, disclosed is a method for a total body workout, the method comprising providing an exercise machine comprising: a platform that has a proximal end and a distal end, the proximal end comprises a front bar mounted over a front base and one or more recoiling shock absorbers sandwiched between the front bar and the front base, the distal end of the platform comprises a rear bar pivotally coupled to a rear base, a lower frame mounted over the platform, a lower drive assembly mounted to the lower frame, the lower drive assembly comprises a pair of pedals, an upper frame mounted to the lower frame, and an upper drive assembly mounted to the upper frame, the upper drive assembly comprises a pair of handles, wherein the exercise machine is configured such that a person can stand on the pair of pedals while grabbing the pair of handles and rotate the pair of pedals by legs and the pair of handles by hands in a cycling motion. The method further comprises the steps of standing in an upright position on the pair of pedals while grabbing the pair of handles; and rotating the pair of pedals by legs and the pair of handles by hands in a cycling motion.

In one implementation of the method, the front bar is parallel to the rear bar, wherein the platform further comprises one or more support bars that extend between the front bar and the rear bar. The front base and the rear base are integral. The upper frame is telescopically coupled to the lower frame such that to increase or decrease a distance between the upper drive assembly and the lower drive assembly. The lower drive assembly comprises a first flywheel operably coupled to the pair of pedals, and a first variable resistance member configured to resist a rotation of the first flywheel. The upper drive assembly comprises a second flywheel operably coupled to the pair of handles, and a second variable resistance member configured to resist a rotation of the second flywheel.

BRIEF DESCRIPTION OF DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Disclosed is an exercise machine for a total body workout and building coordination among body movements. The disclosed exercise machine is compact and requires a limited floor area. The level of resistance can be adjusted according to the needs of a user. Moreover, the resistance for the upper body portion and the legs can be adjusted separately making the disclosed apparatus versatile and the exercise experience better, joyful, and time-efficient.

Figure 1:
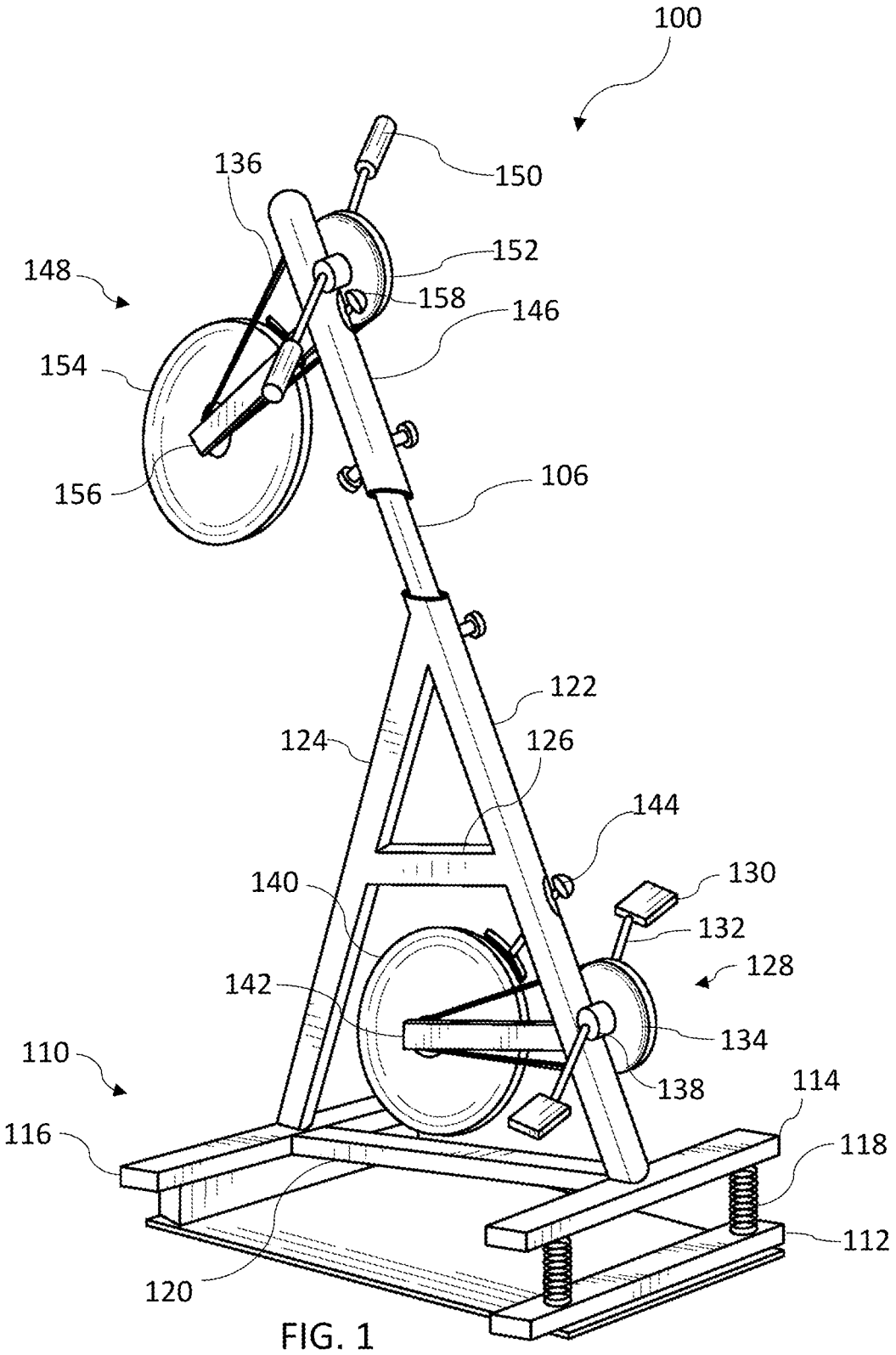
FIG. 1 is a perspective view of the exercise machine, according to an exemplary embodiment of the present invention.
Figure 2:
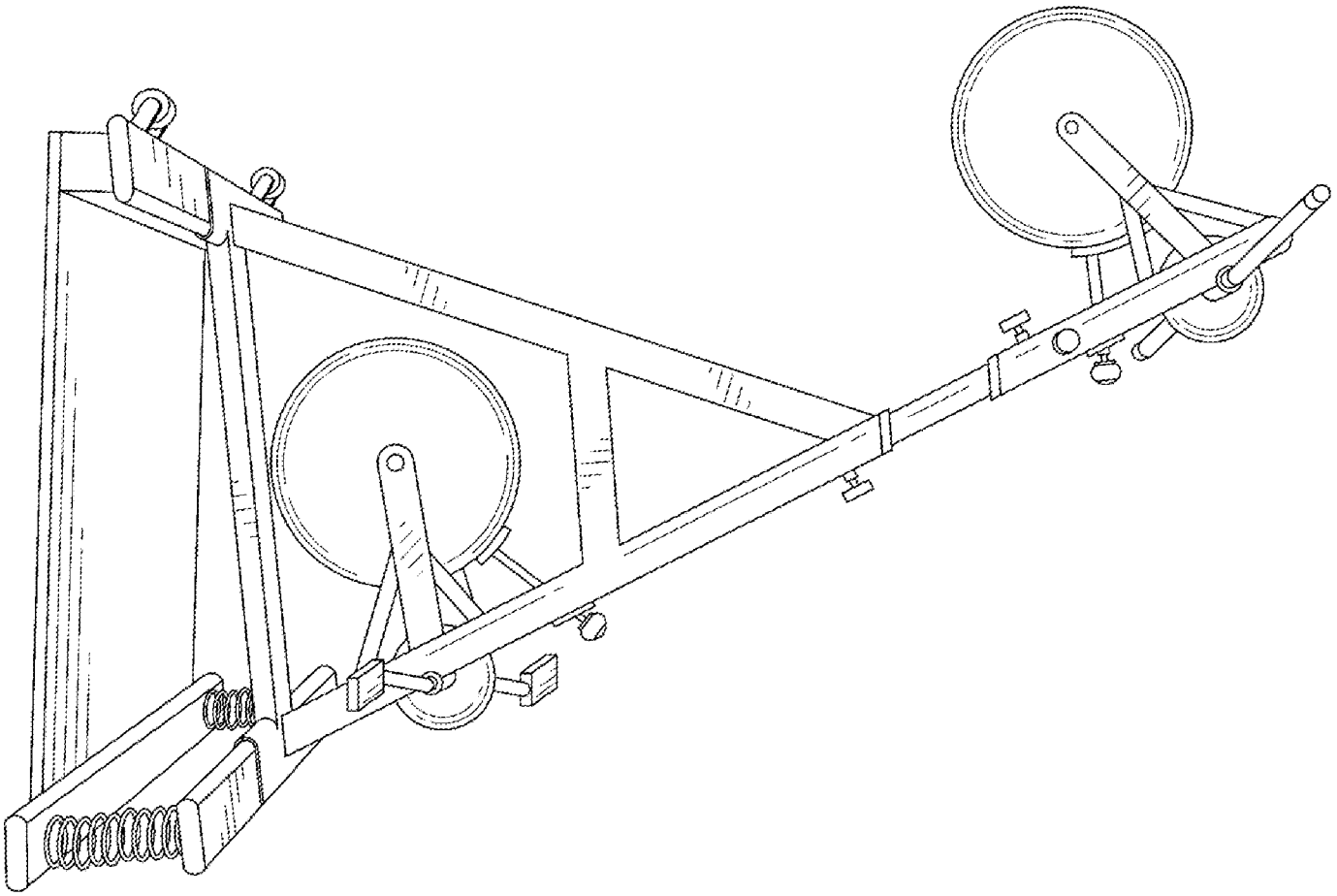
FIG. 2 is a side view of the exercise machine, according to an exemplary embodiment of the present invention.

Referring to FIG. 1 which shows a perspective view of the disclosed exercise machine 100. The exercise machine 100 can include a platform 110 that is mounted to a base 112. The platform 110 has a proximal end and a distal end. The platform can have a front bar 114 at the proximal end and a rear bar 116 at the distal end. The front bar can be mounted to the base through one or more recoiling shock absorbers, such as coil springs and gas compression springs. FIG. 1 shows a pair of coil springs 118 as the shock absorbers sandwiched between the front bar and the base. The rear bar can be pivotally mounted to the base. While FIG. 1 shows a common base to which the front bar and the rear bar can be mounted, however, the reader of this disclosure will appreciate that the front bar and the rear bar can be mounted to two separate bases without departing from the scope of the present invention. The front bar and the rear bar can be rectangular or square that are parallel to each other. However, any other shape of the two bars is within the scope of the present invention. A third bar i.e., a support bar 120 can also be seen traversing the front and rear bars to form a capital letter I or H-like shape. The support bar extends between the middle of the front bar and the rear bar. The support bar can provide the stability to the platform, however, more than one support bars are within the scope of the present invention. Also, while FIG. 1 shows the support bar perpendicular to the front bar, the support bar can be coupled to the front and rear bars at any other angle, such as in a cross shape. In one case, two support bars can extend between the front and rear bars at their ends to form a rectangular shape platform.

A front beam 122 is upstanding from the front bar 114 at an acute angle relative to the support bar 120. The rear beam 124 is upstanding from the rear bar 116 and a tip of the rear beam intersects the front beam. The front beam and the rear beam can form a lower frame of the exercise machine. FIG. 1 shows a top end of the rear beam coupled to the front beam just below a top end of the front beam and a bridge beam 126 extends between the front beam and the rear beam to form a substantially A-shape lower frame. It is understood, however, that the rear beam and the bridge beam can be optional, and the rear beam can intersect the front beam at any other point.

A lower drive assembly 128 can be mounted to the lower frame. The lower drive assembly can include a pair of pedals 130 connected by a shaft 132. A crank wheel 134 can also be mounted to the shaft. The shaft 132 is rotatably mounted to a shaft housing 138, wherein the shaft housing can be fixedly coupled to the front beam 122. The shaft can rotate within the shaft housing by rotating the pair of pedals, resulting in the rotation of the crank wheel. A user can stand upon the pair of paddles and can drive the paddles in a cycling motion. The lower drive assembly can further include a lower flywheel 140 operably coupled to the crank wheel 134, such that the rotation of the crank wheel 134 can in turn rotate the flywheel 140. For example, the crank wheel 134 and the flywheel 140 can be connected through a frictional belt that can transfer the rotation motion of the crank wheel 134 to the flywheel 140. The flywheel 140 can be positioned behind the front beam 122. FIG. 1 shows the first flywheel 140 positioned between the front beam 122, the bridge beam 126, the rear beam 124, and the support bar 120 of the platform 110. The flywheel 140 can be supported by a pair of legs 142 extending from the front beam 122, however, any other means to support or mount the first flywheel 140 is within the scope of the present invention. A resistance member 144 can be operably coupled to the flywheel 140 to provide variable resistance to the rotation of the flywheel 140. The resistance member 144 can be friction-based or magnetic-based that opposes the rotation of the flywheel 140. The resistance member 144 can also include an adjuster for increasing or decreasing the resistance. The structure and functioning of the resistance member for use in exercise cycles are well known, and any such mechanism for providing resistance to the rotation of flywheel and adjusting the level of resistance is known to a skilled person for use in exercise apparatuses is within the scope of the present invention.

The disclosed exercise machine 100 can further include an upper frame 146. An upper drive assembly 148 can be mounted to the upper frame 146. The upper frame 146 can be telescopically coupled to the lower frame such that a distance between the upper drive assembly 148 and the lower drive assembly 128 can be increased or decreased. The upper frame 146 can include an upper beam that is slidably coupled to the front beam. The front beam can be hollow at least in the top portion. The upper beam can include an extension that can be telescopically inserted into the hollow front beam. The width and height of the upper beam can be similar to the width and height of the front beam.

The upper drive assembly 148 can include a shaft rotatably mounted to a shaft housing, the shaft hosing can be mounted to the upper beam, to the shaft can be mounted two handles 150 that can be grabbed for rotating the handles in a cycling motion. A crank wheel 152 is also attached to the shaft that can rotate with the shaft. The upper drive assembly is so located that a person while standing on the two pedals can grab the two handles and rotate the pedals by legs and two handles by the hands in a cycling option. The height of the upper drive assembly can be adjusted by the person according to their comfort and need. The upper drive assembly can also include a flywheel 154 mounted to the upper beam through supporting legs 156. The flywheel 154 is operably coupled to the upper crank wheel 152 wherein the rotation of the crank wheel 152 can rotate the flywheel 154. A resistance member 158 can also be provided for the flywheel that resists the rotation of the flywheel 154 and thus of the crank wheel 152, and the person has to apply more force to rotate the crank wheel 152. The resistance member 158 can be similar to the resistance member 144 of the lower drive assembly, however, the two resistance members can be independently operated.

In certain embodiments, the shock absorbers, such as the Coil springs can aid in an effective total body workout, especially the angle oscillations can change the workout dramatically. The front longitudinal bar, the two coil springs, and the base over which the coil springs are mounted are essential to make the workout effective and easier. It is understood, however, that the coil springs can be replaced by recoiling shock absorbers. The shock absorbers can work with the pivoting rear bar of the platform. The pivoting mechanism can include two hinges for the pivot that allow the exercise machine to have a range of forwarding tilting angles that makes for a perfect cardio workout, and more specifically, a high-intensity interval training. The range of forwarding tilting angles can be adjusted based on the desired workout or weight of a person. For example, the range can be 55 to 70 degrees, more preferably the range can be 60 to 64 degrees, 64 to 68 degrees, or 56 to 60 degrees. The hinged platform and the shock absorbers, with suitable rubber bushings, can allow the disclosed machine to pivot to attain the user's desired oscillation or angle for the workout. The hinge can allow the disclosed exercise machine to pivot, such as about 4-degree range while oscillating. Moreover, the use can adjust the tilt angle of the apparatus using the pivot.

In certain implementations, the upper flywheel can operate independently of the lower flywheel. Moreover, the resistance members can be different for both. The flywheels can be rotated in either direction. For example, the upper flywheel can be rotated clockwise or anticlockwise independent of the lower flywheel. The lower flywheel can be made to rotate in only one direction, such as clockwise. The standing rotary principle provides a full and thorough range of motion exercises. Such a workout not only increases the flexibility of various joints but also improves the stability of each joint by adding strength to supporting joint muscles. The upper and lower isokinetic exercise works the arms, chest, shoulders, and legs through various angles, and provides a maximum caloric burn. The workouts on the disclosed exercise machine increase the basal metabolic rates dramatically and improve speed, power, and endurance. The versatility of the disclosed exercise machine makes it fully adjustable for all body types. The exercise machine provides a smooth, non-jarring, and standing rotary action.

The disclosed exercise machine can include sensors, power meters, strain gauges, electro-magnetic resistance, and like devices to measure the parameters of a workout. For example, the display can be provided on the exercise machine, such that on the lower frame, which displays the rpm of both flywheels separately. Additional calculations, such as calories burnt, the proportion of stress between the upper and lower body exercise can also be displayed.

A smartphone app can also be provided that can capture data from different sensors on the disclosed exercise machine and perform analysis. For example, the workout can be measured by watts of electricity generated by the rotation of the flywheels. In one case, if a workout generated 320 watts total, the display could instead show: the upper flywheel watts generated accounts for only 35% of the 320 watts, thus implying that the lower body generated 65% of the 320 watts or 208 watts.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An exercise machine comprising:

a platform having a proximal end and a distal end, the proximal end comprises a front bar mounted over a front base and one or more springs sandwiched between the front bar and the front base, the distal end of the platform comprises a rear bar pivotally coupled to a rear base;

a lower frame mounted over the platform;

a lower drive assembly mounted to the lower frame, the lower drive assembly comprises a pair of pedals;

an upper frame mounted to the lower frame; and an upper drive assembly mounted to the upper frame, the upper drive assembly comprises a pair of handles, wherein the exercise machine is configured such that a user can stand on the pair of pedals while grabbing the pair of handles and rotate in a cycling motion the pair of pedals using the user's legs and the pair of handles by using the user's hands.

2. The exercise machine according to claim 1, wherein the front bar is parallel to the rear bar, wherein the platform further comprises one or more support bars that extend between the front bar and the rear bar.

3. The exercise machine according to claim 2, wherein the front base and the rear base are integral.

4. The exercise machine according to claim 1, wherein the upper frame is telescopically coupled to the lower frame such that to increase or decrease a distance between the upper drive assembly and the lower drive assembly.

5. The exercise machine according to claim 1, wherein the lower drive assembly comprises a first flywheel operably coupled to the pair of pedals, and a first resistance member configured to resist a rotation of the first flywheel.

6. The exercise machine according to claim 5, wherein the upper drive assembly comprises a second flywheel operably coupled to the pair of handles, and a second resistance member configured to resist a rotation of the second flywheel.

7. A method for a total body workout, the method comprising:

providing an exercise machine comprising:

a platform that has a proximal end and a distal end, the proximal end comprises a front bar mounted over a front base and one or more springs sandwiched between the front bar and the front base, the distal end of the platform comprises a rear bar pivotally coupled to a rear base, a lower frame mounted over the platform, a lower drive assembly mounted to the lower frame, the lower drive assembly comprises a pair of pedals, an upper frame mounted to the lower frame, and an upper drive assembly mounted to the upper frame, the upper drive assembly comprises a pair of handles, wherein the exercise machine is configured such that a user can stand on the pair of pedals while grabbing the pair of handles and rotate in a cycling motion the pair of pedals using the user's legs and the pair of handles by using the user's hands;

standing in an upright position on the pair of pedals while grabbing the pair of handles; and rotating in a cycling motion the pair of pedals using the user's legs and the pair of handles using the user's hands.

8. The method according to claim 7, wherein the front bar is parallel to the rear bar, wherein the platform further comprises one or more support bars that extend between the front bar and the rear bar.

9. The method according to claim 8, wherein the front base and the rear base are integral.

10. The method according to claim 7, wherein the upper frame is telescopically coupled to the lower frame such that to increase or decrease a distance between the upper drive assembly and the lower drive assembly.

11. The method according to claim 7, wherein the lower drive assembly comprises a first flywheel operably coupled to the pair of pedals, and a first resistance member configured to resist a rotation of the first flywheel.

12. The method according to claim 11, wherein the upper drive assembly comprises a second flywheel operably coupled to the pair of handles, and a second resistance member configured to resist a rotation of the second flywheel.

* * * * *